United States Patent [19]

Schleffendorf

[11] 4,338,833

[45] Jul. 13, 1982

[54] METHOD OF MAKING A TOOL

[76] Inventor: Frank Schleffendorf, 2717 W. Agatite, Chicago, Ill. 60625

[21] Appl. No.: 170,097

[22] Filed: Jul. 18, 1980

Related U.S. Application Data

[62] Division of Ser. No. 967,227, Dec. 7, 1978, Pat. No. 4,240,479.

[51] Int. Cl.[3] ..... B21K 5/14; B21K 25/00

[52] U.S. Cl. ..... 76/103; 403/273; 403/282; 29/447; 29/517

[58] Field of Search ..... 76/103; 145/61 D, 29 R; 403/273, 282, 284; 29/447, 517

[56] References Cited

U.S. PATENT DOCUMENTS

| | | | |
|---|---|---|---|
| 1,643,110 | 9/1927 | Briggs | 403/284 |
| 1,643,150 | 9/1927 | Conner | 403/284 |
| 1,910,269 | 5/1933 | Sunderland | 403/284 |
| 2,066,598 | 1/1937 | Wiessner | 145/61 D |
| 2,619,860 | 12/1952 | Gray, Jr. | 81/477 |

FOREIGN PATENT DOCUMENTS

| | | | |
|---|---|---|---|
| 525282 | 5/1931 | Fed. Rep. of Germany | 145/61 D |
| 366955 | 3/1963 | Switzerland | 29/447 |

*Primary Examiner*—Roscoe V. Parker

*Attorney, Agent, or Firm*—Mason, Kolehmainen, Rathburn & Wyss

[57] ABSTRACT

An unbreakable sledge hammer handle includes a conventional, wood or other rigid lower handle portion and a wire rope connector for mounting the hammer head on the top end of the hammer. A pair of collars are fit on the opposite ends of the wire rope connector and secured thereto by applying extreme pressure to the collar which deforms and cold works the interior diameter to fill in the gaps between the wire segments. The sledge hammer head is provided with a cylindrical mounting aperture which is smaller in diameter than the outside diameter of the collar. The hammer head is subsequently heat shrunk onto the collar. The opposite end of the wire rope connector is secured to the wooden handle portion by a sleeve which extends a substantial length over the exterior of the handle portion. The sleeve is riveted to the wooden handle portion and spot welded to the collar.

1 Claim, 8 Drawing Figures

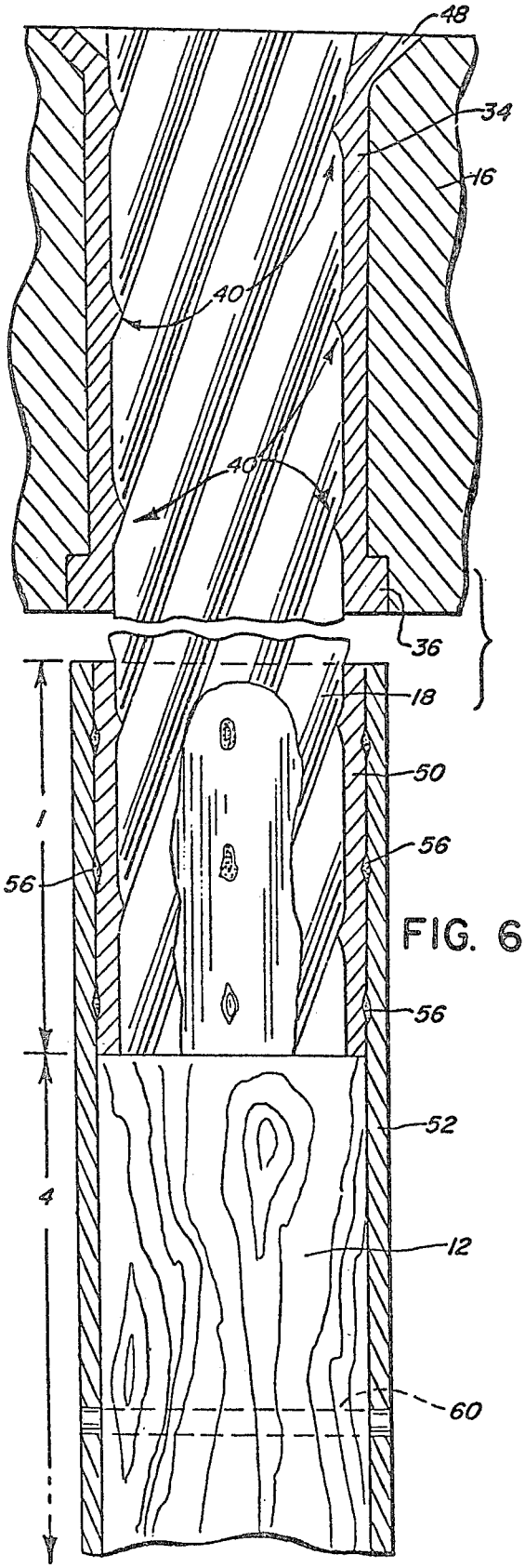
FIG. 6
FIG. 7 PRIOR ART
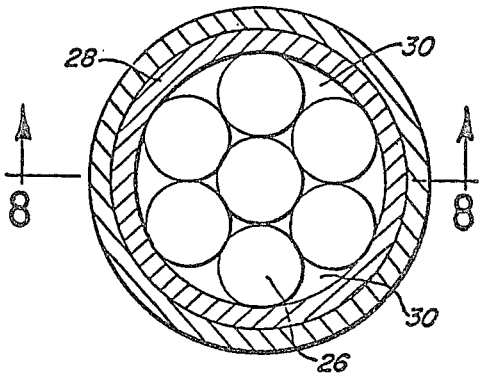
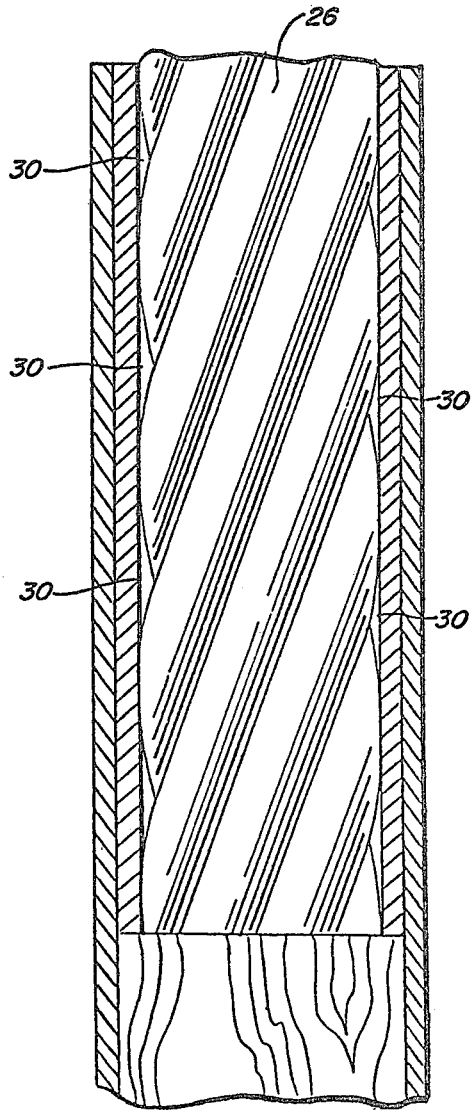
FIG. 8 PRIOR ART

METHOD OF MAKING A TOOL

This is a division of Application Ser. No. 967,227 filed Dec. 7th, 1978 and now U.S. Pat. No. 4,240,479.

BACKGROUND OF THE INVENTION

1. Field of the Invention

This invention relates to tool handles and in particular to a novel, unbreakable handle for a sledge hammer.

2. Brief Description of the Prior Art

In the past, many attempts have been made to provide a flexible coupling between a tool, such as a hammer head, and a handle for manipulating the tool. Such prior art attempts have included the use of a flat, leaf-type spring, a coil spring, and many other types of connectors. The provision of flexible elements within hammer handles was believed to add to the usefulness of the handle since it would accept a certain amount of shock and prevent the transmission of this shock to the user. However, it has been found that in order to eliminate shock, the connector becomes extremely flexible, and therefore, difficult to use as a hammer.

German Patent No. 525282, issued May 21, 1931, discloses the use of a section of wire rope between the handle portion and the end in which the tool is mounted. However, the present invention provides an improvement in the art by providing a novel apparatus and method of securing the respective elements to the ends of a wire rope section.

SUMMARY OF THE INVENTION

It is an object of this invention to provide a new and useful tool handle which is substantially unbreakable in its intended use.

It is another object of the present invention to provide a connecting means for securely mounting the tool, such as a hammer head, to a conventional handle, such as a wooden handle, for preventing relative rotation of the tool with the handle during use.

It is yet another object of the present invention to provide a method for making a sledge hammer in which a wire rope connector portion greatly reduces the breakage of handles during normal use.

An unbreakable sledge hammer handle includes a conventional, wood or other rigid lower handle portion and a wire rope connector for mounting the hammer head on the top end of the hammer. A pair of collars are fit on the opposite ends of the wire rope connector and secured thereto by applying extreme pressure to the collar which deforms and cold works the interior diameter to fill in the gaps between the wire segments. The sledge hammer head is provided with a cylindrical mounting aperture which is smaller in diameter than the outside diameter of the collar. The hammer head is subsequently heat shrunk onto the collar. The opposite end of the wire rope connector is secured to the wooden handle portion by a sleeve which extends a substantial length over the exterior of the handle portion. The sleeve is riveted to the wooden handle portion and spot welded to the collar.

The foregoing and other objects of the present invention will become apparent from the following detailed description of the present invention.

BRIEF DESCRIPTION OF THE DRAWINGS

FIG. 6 is a vertical section showing the connection of the wire rope connector to the hammer head and the wooden handle;

FIG. 7 is a top plan view of the prior art; and

FIG. 8 is a vertical section of the prior art taken generally along line 8—8 of FIG. 7.

DESCRIPTION OF THE PREFERRED EMBODIMENT

Figure 1:
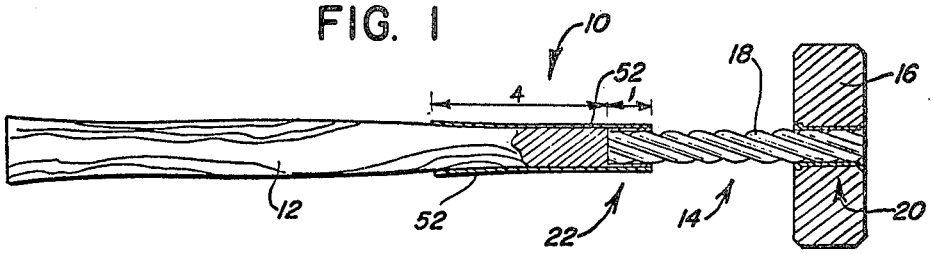
FIG. 1 is a side elevational view of a sledge hammer, partially shown in section, made in accordance with the concepts of the present invention.

A tool handle, particularly adapted for use with an impact tool, such as a sledge hammer, made in accordance with the concepts of the present invention, is shown in FIG. 1 and indicated by the reference numeral 10. While the tool handle 10 of the present invention can be used with many types of tools, and in particular, impact tools, it is shown and described herein with reference to its application on a sledge hammer without limiting the nature and scope of the invention. The handle 10 includes a conventional generally elongated wooden handle portion 12 and a connection means 14 which secures the handle to a tool, such as the sledge hammer head 16.

The connection means 14 includes a wire rope section 18, an upper fastening means, generally designated 20, for connecting the head 16 to one end thereof, and a lower fastening means 22 for connecting the other end of the wire rope 18 to the elongated handle portion 12. Prior attempts to utilize a wire rope section for an impact tool resulted in several deficiencies, the structural differences of which are shown in FIGS. 7 and 8 hereof. In particular, the prior art utilized a wire rope section such as the section 26 in which six outer wires are wrapped about an inner wire in a generally spiral fashion. The prior art devices, such as shown in the above-referenced German patent and in U.S. Pat. No. 2,619,860 provide a cylindrical connector 28 which was connected to the end of the wire rope 26. However, because of the outer diameter of the wire rope 26, defined by the largest circumscribing circle of the six outer wire portions, there is very little contact between the sleeve 28 and the wire rope itself, only six, theoretical lines of contact. This factor left many vacancies, such as the six generally triangular voids 30 between the inner wall of the sleeve 28 and the wire rope. In a side elevational view, these vacancies 30 can be seen to extend along substantial lengths between the wire rope 26 and the sleeve 28. These voids and vacancies 30, in addition to the theoretical point or line contact between the elements 26 and 28 greatly reduces the strength and rigidity of the connection. When such a connection is applied to an impact tool, such as a sledge hammer, were very high forces and stresses are applied at the juncture, the head would tend to loosen and, particularly, possibly twist due to torsional forces if an exact hit were not accomplished by the user. The present invention solves this particular problem as described in detail hereinafter.

Figure 2:
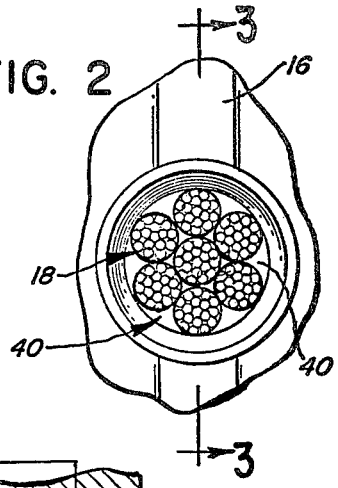
FIG. 2 is a top plan view of the upper end of the handle mounted within the hammer head.

The wire rope section 18 may be of a standard or conventional type. The particular type of wire rope selected for use in the present invention is designated a 6×25 filler wire. Each of the six outer strands of the filler wire includes a central wire about which six identically sized wires are wrapped, followed by six substantially smaller wires which fill the gaps about the six, followed by an outside layer of twelve identically sized wires. The top view of FIG. 2 shows the end view of the 6×25 filler wire 18 in its assembled form in the hammer head.

Figure 4:
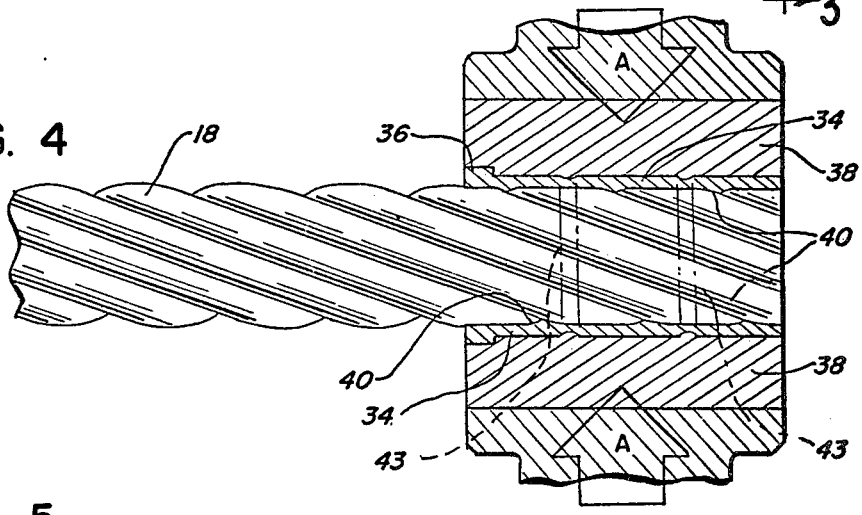
FIG. 4 is a cross-sectional view, similar to FIG. 3, showing schematically the step of hydraulically deforming a collar onto the wire section.
Figure 5:
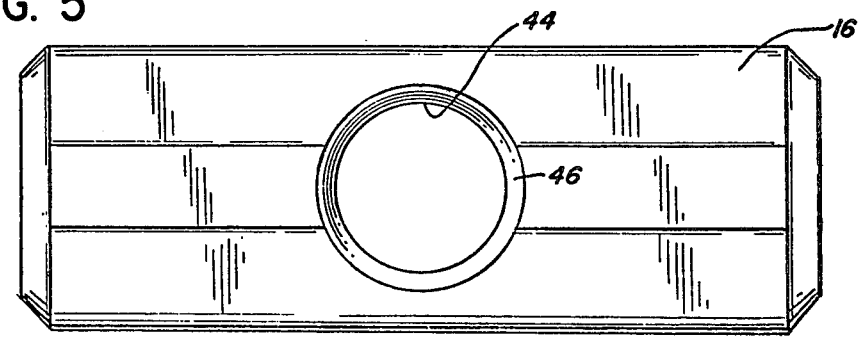
FIG. 5 is a top plan view of a hammer head having a cylindrical mounting aperture.

The first step in manufacturing the tool handle is the attachment of the upper fastening means 20 to the wire rope 18, as shown in FIG. 4. The upper fastening means 20 includes a generally cylindrical collar 34 which has an internal diameter approximately equal to the diameter of the wire rope 18, and a substantially larger outer diameter. One end of the collar 34 includes a chamfer which defines a shoulder 36. The collar 34 is preferably manufactured of cold rolled steel so that it can be cold worked and maintain a deformed position. In one method contemplated by the present invention, referring to FIG. 4, the collar 34 is fit on one end of the wire rope 18 and the assembly is inserted into the jaws 38 of a hydraulic pressuring device. Then, hydraulic pressure of approximately 600 tons is applied in the direction of the arrows A to compress the collar 34 causing the internal diameter or the interior surfaces thereof to become cold worked and fill in the gaps 40 along the length of the wire with material from the collar itself. In the top view, the filled in, generally triangular shaped areas 40 have been darkened with respect to the collar to emphasize the filling in of the vacancies 30 of the prior art by cold working of the collar 34 itself. This tremendous hydraulic pressure has also been found to cause the external diameter of the wire to be reduced by a significant amount, also indicating that the end of the wire rope within the collar 34 has been compressed to an even greater degree than in its normal form. Thus, the collar 34, in one method, is securely fastened to the end of the wire rope by compressive forces which solidly connect the end of the wire rope 18 to the collar 34. It is also possible that a plurality of compression rings or grooves 43 may be impressed on the exterior of the collar 34 to create additional stress, friction, and facilitate the filling of the voids along the length of wire rope 18. Although only two grooves are shown in FIG. 4, it is contemplated that as many as ten or more grooves may be appropriate.

In an alternative form of the present method, the end of the wire rope 18 can be prepared in a manner similar to that used for zinc plating and the collar 34 can be secured to the end of the wire rope 18 by simultaneously press fitting the collar 34 on the end while filling all of the gaps adjacent the collar, and gaps within the wire rope 18 itself, with molten metal, such as zinc itself. In both methods, the binding of the end of the wire prevents any unraveling, and in fact, adds rigidity to the wire rope section itself.

Figure 3:
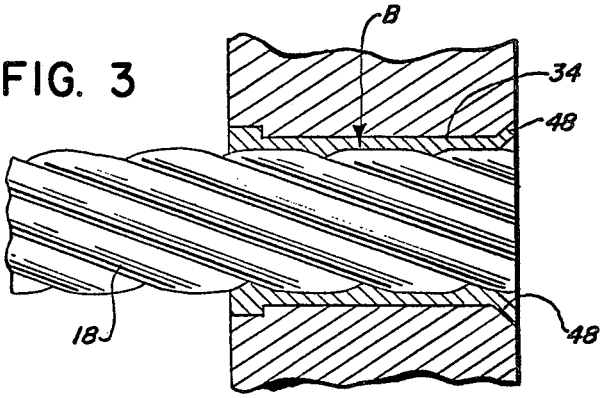
FIG. 3 is a vertical section of the connection between the handle and the hammer head taken generally along line 3—3 of FIG. 2.

The upper fastening means is then secured to a tool, such as a sledge hammer head 16. The pressurizing step described above maintains a cylindrical outside diameter for the collar 34, and therefore the collar can fit within a cylindrical aperture in a tool handle. Prior art sledge hammer heads always require an expensive, oblong aperture for mounting a wood handle. However, in the present application, an oblong aperture is not required. The sledge hammer head 16 is provided with a cylindrical aperture 44 and is heated prior to assembly which causes the aperture 44 to become larger due to expansion. The collar 34 may be chilled prior to insertion into the aperture 44 of the heated head 16 by a press fit. After the head is permitted to reach room temperature, very substantial compressive forces will be generated which maintain the head securely on the collar 34. In addition, to further secure the head, the upper surface of the aperture 44 is provided with a chamfered edge 46 and the steel collar 34 is flared, as at 48, shown in FIG. 3. The compressive forces of the pressurizing or hydraulic crimping step and the cooling of the head 16 will generate compressive forces on the wire rope 18 which are greatest in the center of the head as shown by arrow B which forces taper off from the center toward the ends.

Referring to FIG. 6, the flaring of the upper end of the collar 34 is shown more clearly by the arrows and, in this enlarged view, the filled in areas 40 are shown in cross section with the collar.

The lower fastening means 22 which secure the opposite end of the wire rope to the wooden handle 12 is slightly different than the upper fastening means 20. Referring to FIG. 6 in particular, a collar 50 is similarly secured to the opposite end of the wire rope 18. This opposite end may or may not include the shoulder 36 as on the top collar 34. Again, the pressurizing step deforms a portion of the collar to fill the gaps within the areas adjacent the wire rope 18. The lower collar 50 is then secured to the wooden handle portion 12 by an elongated sleeve 52. The internal diameter of the sleeve 52 is substantially identical to the outer diameter of the collar 50 on one end and may be tapered to fit snugly on the exterior of a preshaped wooden handle portion 12. The upper end of the sleeve 52, the end adjacent the hammer head, is secured to the sleeve by a plurality of spot welds 56 shown in FIG. 6. The lower portion of the sleeve 52 is secured to the wooden portion of the handle by a plurality of rivets 60. Thus, the rivets secure the sleeve 52 on the end of the wooden shank 12 and the spot welds 56 secure the collar 50 to the upper end of the sleeve 52. This construction completes the assembly of the tool handle and its connection to, in this case, a hammer head. Preferably, the length of the sleeve 52 which overlaps the wooden handle portion 12 is approximately 4 times the length that overlaps or encloses the collar 50.

Many alternate constructions of the present invention are possible without departing from the spirit and scope thereof. For example, the length of the wire rope 18 can be of any suitable length to provide more or less rigidity and weight balance in the handle portion itself. In addition, during assembly of the collars 34 and 50 (which may be done simultaneously) on the opposite ends of the wire 18, the wire may be twisted in the direction of the wrap of the individual components to assure that all gaps or other loose areas within the wire are themselves eliminated. This construction provides an extremely rigid, usable tool handle which is not susceptible to many of the normal breaking problems associated with wooden tools. For example, when attempting to drive a ⅛" steel plate into the ground to form a barrier wall or when using wedges to split logs, for example, a slight miscalculation of the user which causes the hammer head 16 to miss its target and forces the handle to absorb the shock as it engages the work piece, will normally cause a wooden sledge hammer handle to break. The particular advantage, and that which makes the handle unbreakable, of the present invention, is that the wire rope portion 18 will not be broken. The invention disclosed herein could easily be incorporated in any device having one elongated handle without departing from the spirit and scope of this invention. For example, this invention could be used on tennis racquets, golf clubs and other sporting equipment as well as other tools, such as screwdrivers, torque wrenches, or the like.

Many other advantages and other uses of the present invention will become obvious in view of this disclosure and therefore, the foregoing detailed description has been given for clearness of understanding only and no unnecessary limitations should be understood therefrom as some modifications will be obvious to those skilled in the art.

I claim:

1. A method of making a tool, comprising steps of;

providing a predetermined length of wire rope;

providing a pair of fastening collars having an inside diameter substantially equal to the outside diameter of said wire rope;

connecting the collars to the ends of said wire rope and cold working one of said collars to deform the internal surface to conform to the external surface of the wire rope; and fastening the cold worked collar to a tool head by heat shrinking the tool head onto the collar and fastening the other collar to a handle portion.

* * * * *